US008397469B2

(12) United States Patent
Temnyenkov

(10) Patent No.: US 8,397,469 B2
(45) **Date of Patent: *Mar. 19, 2013**

(54) ENERGY ABSORBING ELEMENT FOR WALL OPENINGS AND METHODS OF USE THEREFOR

(75) Inventor: Igor Temnyenkov, Lod (IL)

(73) Assignee: Arpal Aluminium Ltd., Lod (IL)

( * ) Notice: Subject to any disclaimer, the term of this patent is extended or adjusted under 35 U.S.C. 154(b) by 0 days.

This patent is subject to a terminal disclaimer.

(21) Appl. No.: 13/495,843

(22) Filed: Jun. 13, 2012

(65) Prior Publication Data

US 2012/0255247 A1 Oct. 11, 2012

Related U.S. Application Data

(63) Continuation of application No. 12/224,981, filed as application No. PCT/IL2007/000164 on Feb. 7, 2007, now Pat. No. 8,209,936.

(30) Foreign Application Priority Data

Mar. 13, 2006 (IL) ..... 174280

(51) Int. Cl.
*E04B 1/00* (2006.01)

(52) U.S. Cl. ..... 52/745.15; 52/167.1; 52/204.599; 52/712; 52/741.3; 52/769

(58) Field of Classification Search ..... 52/204.599, 52/769, 204.1, 213, 745.15, 741.3, 712, 167.1, 52/167.2, 167.4, 167.7, 167.8; 297/470, 297/471

See application file for complete search history.

(56) References Cited

U.S. PATENT DOCUMENTS

| | | | | |
|---|---|---|---|---|
| 3,571,996 | A | 3/1971 | Braswell | |
| 3,586,131 | A * | 6/1971 | Le Mire | 188/371 |
| 4,009,549 | A * | 3/1977 | Hala | 52/506.08 |
| 4,060,278 | A * | 11/1977 | Maeyerspeer | 297/472 |
| 4,450,659 | A * | 5/1984 | Hanaoka et al. | 52/167.1 |
| 5,692,350 | A | 12/1997 | Murphy, Jr. | |
| 6,216,401 | B1 * | 4/2001 | Emek | 52/204.5 |
| 6,922,957 | B2 * | 8/2005 | Saelzer | 52/204.1 |

FOREIGN PATENT DOCUMENTS

| | | |
|---|---|---|
| DE | 2 043 503 | 3/1972 |
| DE | 91 05 462 U1 | 9/1991 |
| FR | 2 797 655 A1 | 2/2001 |
| GB | 2 284 000 A | 5/1995 |

* cited by examiner

*Primary Examiner* — William Gilbert
(74) *Attorney, Agent, or Firm* — Vorys, Sater, Seymour and Pease LLP; Susanne M. Hopkins; William L. Klima

(57) ABSTRACT

Provided is an energy absorber for use in an opening of a wall of a building, the opening defined by a perimeter surface, the wall supporting a closure substantially filling the opening, the closure having respective edges which are substantially parallel to the perimeter surface of the opening. The energy absorber having a planar wall connecting portion, a planar closure connecting portion and a plastically deformable deforming surface therebetween. The connecting portions being substantially parallel to one another and, the deforming surface adapted to absorb, by plastic deformation, a force applied to the closure.

13 Claims, 6 Drawing Sheets

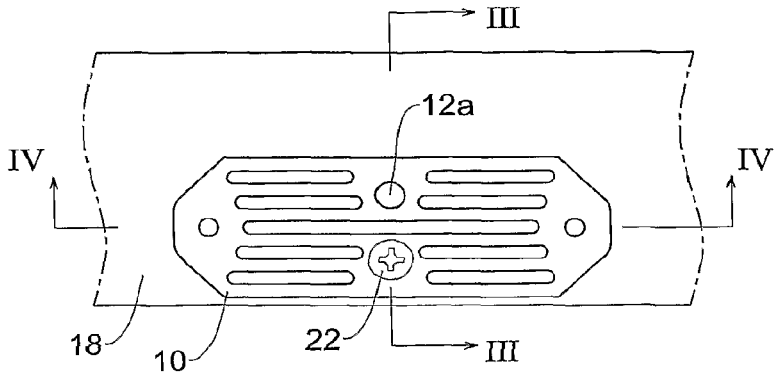
FIG. 3A
FIG. 3B
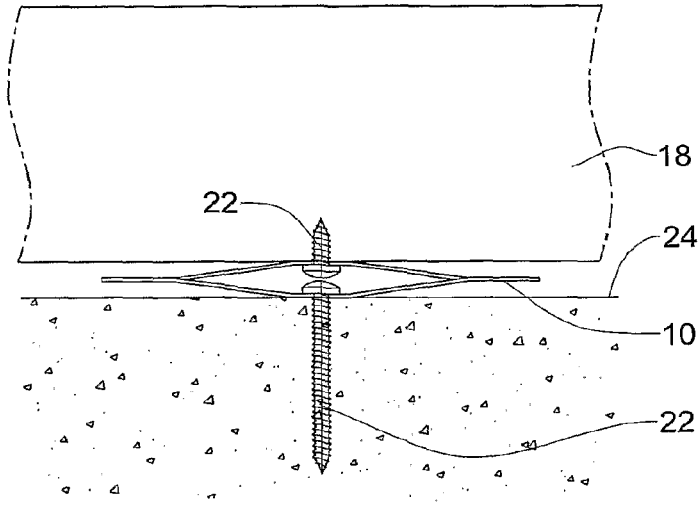
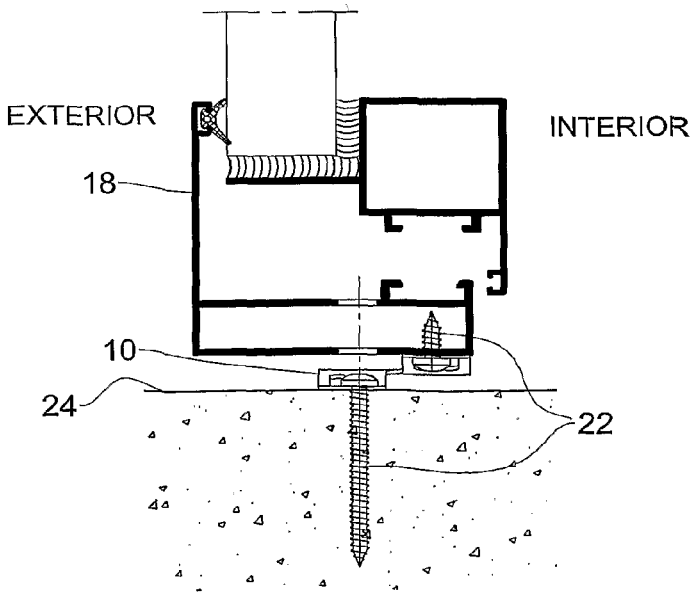
FIG. 3C

ENERGY ABSORBING ELEMENT FOR WALL OPENINGS AND METHODS OF USE THEREFOR

This is a Continuation Application of U.S. patent application Ser. No. 12/224,981, filed on Sep. 11, 2008, which was a National Phase Application filed under 35 U.S.C. §371 as a national stage of PCT/IL2007/000164, filed on Feb. 7, 2007, an application claiming the benefit under 35 U.S.C. §119 of Israeli Application No. 174280, filed on Mar. 13, 2006, the content of each of which is hereby incorporated by reference in their entirety.

FIELD OF THE INVENTION

This invention relates to articles used to secure closures of wall openings against the force of an explosion. More particularly, the invention is concerned with an energy absorbing element for wall openings.

BACKGROUND OF THE INVENTION

With security being an increasing concern, many methods have been utilized to reduce the potential occurrence of injury and damage due to the force of explosions. In particular, protection is desired against inward (i.e., away from the direction of the explosion) displacement of the frame of a window or door due to the blast. Typically, protection from explosions has been provided by the use of passive barriers, such as steel reinforced doors and laminated windows. In order to maintain an adequate level of protection, as the risk has historically increased, new barrier systems have increased in weight, thickness and structural and material complexity. While this may be acceptable in certain situation where ascetics are not a concern, such a bank vault or the like, in uses such as residential homes or office buildings requiring such protection, such solutions are inadequate. In addition, they may draw attention to the high security of the building, rendering it a target for an attack.

U.S. Pat. No. 6,922,957 discloses an opening in a building wall closed by a building closure such as a window or door. A mounting part of the closure arrangement is received in a space between two countersupport surfaces formed by a U-channel or opposite L-members that protrude perpendicularly from the sill or jamb surface of the wall bounding the opening. Mounting brackets secure the U-channel or L-members to the wall. On one or both sides, a respective damping element is interposed between the mounting part and the respective adjacent countersupport surface. The damping element may be a plastically deformable metal strip. When an explosion force acts on the closure arrangement, the damping element is first plastically deformed to absorb energy, before the remaining force is transmitted into the building wall. The two damping elements on opposite sides damp forces from the positive and negative pressure waves of to the explosion.

U.S. Pat. No. 6,216,401 discloses a blast resistant window framework and elements thereof. It describes the construction of the sash section for holding a window pane, being capable of effectively withstanding blast pressure if applied to it. This being achieved by the sash section comprising a main member enabling inter-engagement between the profiled sash member and the outer frame; a window pane holding member for accommodating and securing an end section of window pane in said sash profiled member; a reinforced member designed to support the end portion of the window pane and transmit blast pressure, if incidentally applied to the window pane, to the main member. The structured being resilient to blast pressure due to the applied blast pressure being transmitted to the main member, which deforms to utilize the energy. The sash section may be a profiled body or be composed of multiple inter-engaged segments.

SUMMARY OF THE INVENTION

According to one aspect of the present invention, there is provided an energy absorber used to secure the closure of an opening of a wall of a building from being blown inward from the force of a blast, such as one caused by a nearby explosion.

It should be noted that hereafter in the specification and claims, the term closure is meant to denote a member fitted within the opening formed in a wall, including, for example, a door or a window.

The wall comprises, at each opening, a perimeter surface facing the opening, and a closure substantially filling the space of each opening. Each closure has edges which are substantially parallel to said perimeter surface of the wall. The energy absorber has a planar wall connecting portion, a planar closure connecting portion, and a plastically deformable deforming surface therebetween. The connecting portions are substantially parallel to one another. The deforming surface is adapted to absorb, by plastic deformation, a force applied to the closure by the blast.

The energy absorber may be formed as a metal plate. It may further comprise slots formed along the plate. One of the slots may extend longitudinally along a central axis of symmetry of the absorber. The slot is centrally located along the length of the absorber parallel to the axis and, according to a particular design, is more than two thirds the length of the absorber.

According to one embodiment, the energy absorber is mounted such that the longitudinal slots extend parallel to the perimeter surface and to the respective edge and according to another embodiment the energy absorber is mounted such that the slots are perpendicular thereto.

The energy absorber may comprise two or more throughgoing apertures, disposed about an axis of symmetry thereof. They may optionally be disposed symmetrically thereabout. In addition, it may further comprise two additional throughgoing apertures, disposed symmetrically about a different axis of symmetry of the absorber. The apertures are for attachment of the absorber to the wall and the closure by inserting a fastening element therethrough.

According to another aspect of the present invention, there is provided a method of securing a closure to an opening in a building wall. The method comprises the steps of providing an energy absorber as described above, and securing the absorber to the opening and the closure such that is lies substantially parallel to facing surfaces of the wall and closure. In this way, a force applied of the closure will be absorbed/wasted by plastic deformation of the absorber.

The absorber may be secured to the closure such that a longitudinal axis thereof lies substantially parallel to the plane of the closure. Alternatively, it may be secured to the closure such that a longitudinal axis thereof lies substantially perpendicular to the plane of the closure. In such a case, it may be bent substantially into a J-shape.

According to a further aspect of the present invention, there is provided a closure for a wall opening installed according to the above method.

BRIEF DESCRIPTION OF THE DRAWINGS

In order to understand the invention and to see how it may be carried out in practice, embodiments will now be described, by way of non-limiting examples only, with reference to the accompanying drawings, in which:

FIG. 3A is a top close-up view of one of the absorbers secured to the window as illustrated in FIG. 2;

FIGS. 3B and 3C are cross-sectional views taken along lines and IV-IV in FIG. 3A, respectively;

DETAILED DESCRIPTION OF EXEMPLARY EMBODIMENTS

Figure 1:
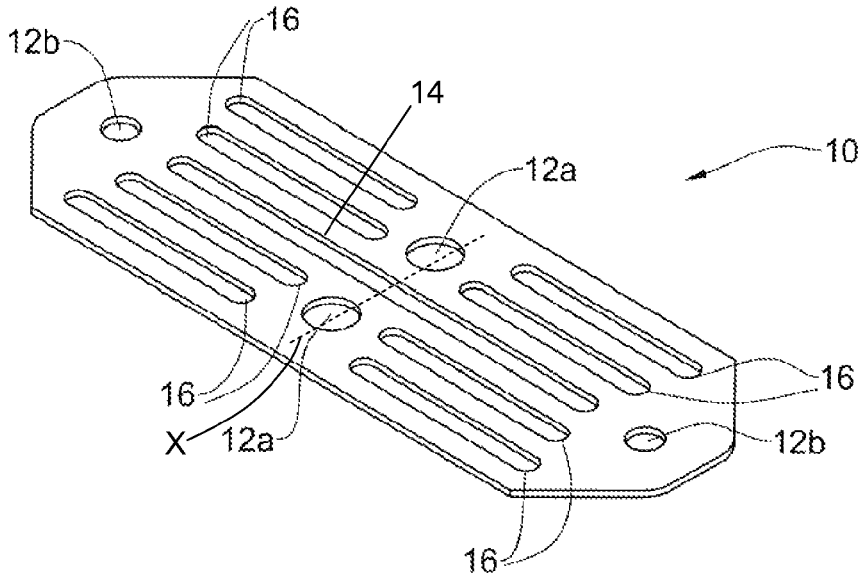
FIG. 1 is a perspective view of an energy absorber according to the present invention.

As illustrated in FIG. 1, there is provided an energy absorber, generally indicated at 10. The absorber 10 comprises mounting 12*a*, ancillary through-going apertures 12*b*, a first slot 14 extending a majority of the length of the absorber and located centrally along its width, and several secondary slots 16. As seen, the first slot 14 extends in a direction perpendicular to an axis X which extends between the two mounting apertures 12*a*, and has a length which is greater than the distance between them. The absorber 10 is made of a material which deforms when subjected to high forces, such as those typical from an explosion. The absorber may be of any suitable thickness, but is typically within the range of between 0.5 to 3 mm.

Figure 2:
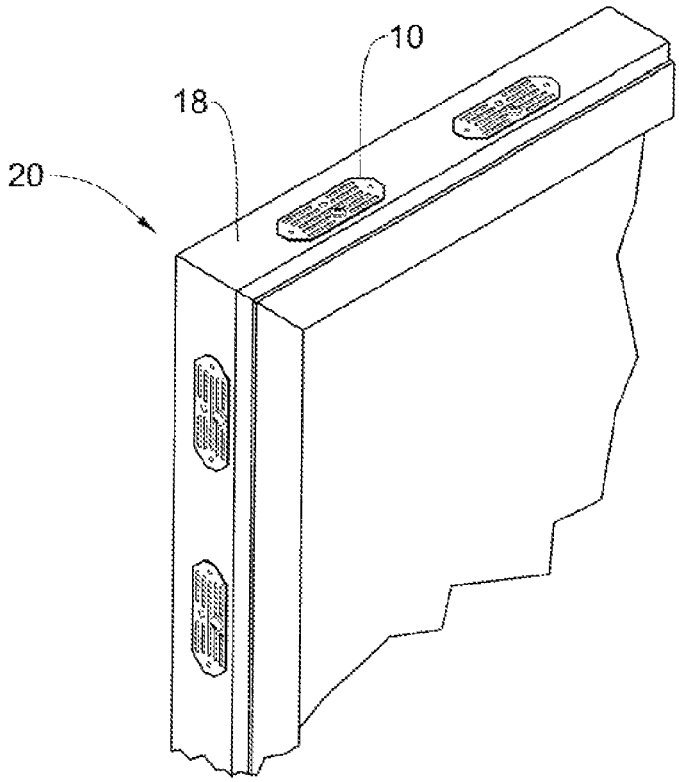
FIG. 2 is a partial view of a typical window, with the absorber illustrated in FIG. 1 secured thereto.

During installation, several absorbers 10 are mounted to the jamb 18 of a window 20, as illustrated in FIG. 2. As seen in more detail in FIG. 3A, it is fastened by means of a fastener 22, such as a screw or other suitable hardware, inserted through one of the mounting apertures 12*a* and into the jamb. As seen in FIGS. 3B and 3C, the side of the absorber 10, opposite that side which had been fastened, is raised, as permitted by the first slot 14. Another fastener 22 is secured to the surface 24 of the wall which faces the opening into which the window is to be installed. In order to permit this, holes (not illustrated) may be provided in the window jamb 18 in order to provide access to the fastener while securing the absorber 10 to the wall.

It should be noted that when installing the window, the side of the absorber 10 which is fastened to the window should be closer to the interior of the structure, and the side of the absorber which is fastened to the wall should be closer to the exterior of the structure. This assumes that the explosion is expected to occur exterior to the building. When the absorber is being installed in order to protect from an explosion expected to occur in the building interior, the above should be reversed. If it is not known where an explosion will occur, or if explosions are expected in both the building interior and exterior, the number of absorbers could be doubled, with half being installed in one direction, and half in the other.

Figure 4A:
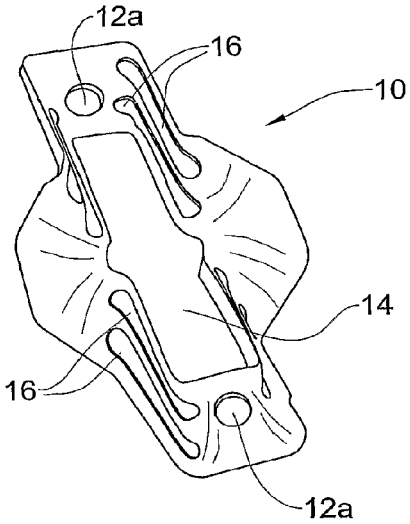
FIGS. 4A and 4B show examples of plastic deformation of absorbers.
Figure 4B:
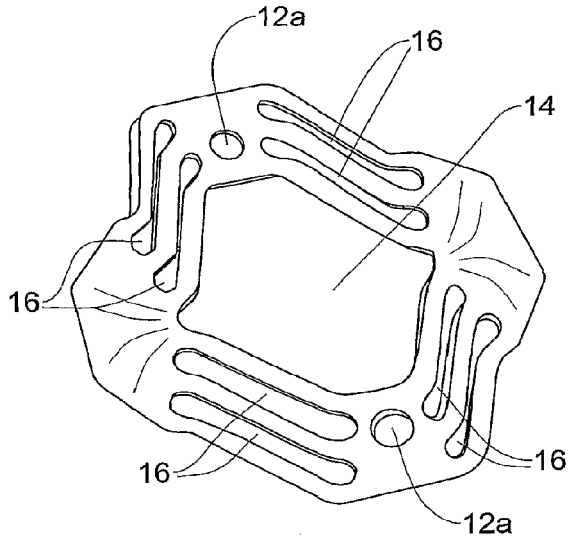

When an explosion happens in the vicinity of the window, the building wall is typically able to withstand the force resulting from the blast. However, the window is pushed out of place by the force of the explosion. As it moves, it pulls the absorber 10 along with it, causing plastic deformation thereof. FIGS. 4A and 4B illustrated typical effects on the absorber 10. (It should be noted that the absorbers illustrated in FIGS. 4A and 4B are of a slightly modified embodiment, which do not comprise ancillary through-going apertures 12*b*.) The energy expended in the plastic deformation of the absorbers 10 reduces the amount of energy available to dislodge the window. Therefore, displacement of the window is minimized, and building fenestration is preserved.

Figure 5:
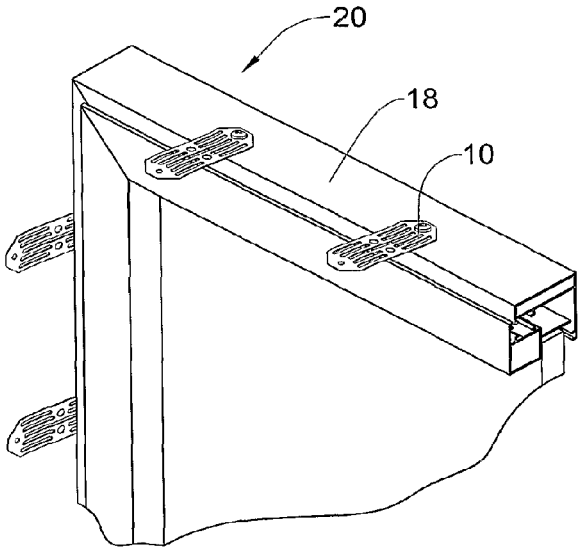
FIG. 5 is a partial view of a the window illustrated in FIG. 2, illustrating another method of securing the absorber illustrated in FIG. 1 thereto.
Figure 6A:
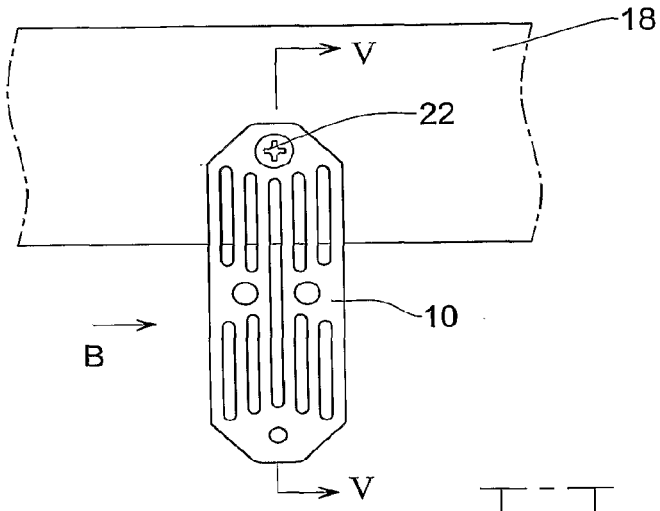
FIG. 6A is a top close-up view of one of the absorbers secured to the window as illustrated in FIG. 5.
Figure 6B:
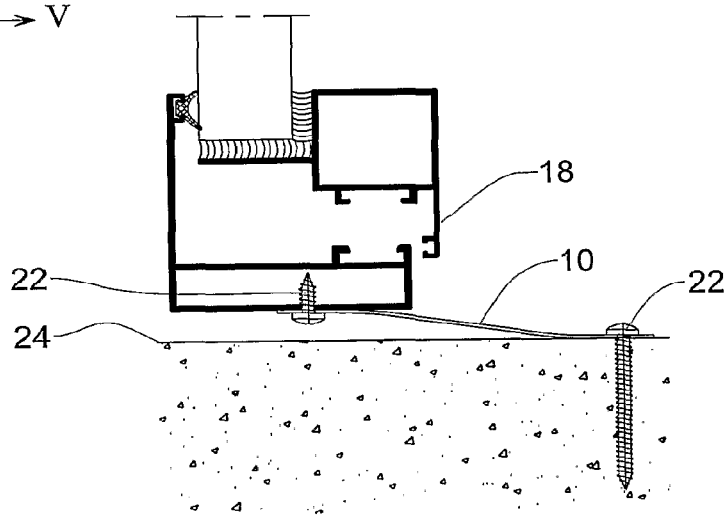
FIG. 6B is a cross-sectional view taken along line V-V in FIG. 6A.

The absorber 10 may also be utilized when the geometry of the window and/or the wall does not permit installation as described above. As illustrated in FIGS. 5 through 6B, the absorber 10 may be fastened to the window jamb such that is lies perpendicular thereto. A fastener 22 is inserted through one of the ancillary through-going apertures 12*b* and secured to the window jamb 18. The absorber 10 is bent slightly as illustrated in FIG. 6B, and secured to the surface 24 of the wall which faces the opening into which the window is to be installed. An explosion on the exterior of the building will cause the absorber 10 to plastically deform under compression, crushing it.

Figure 7:
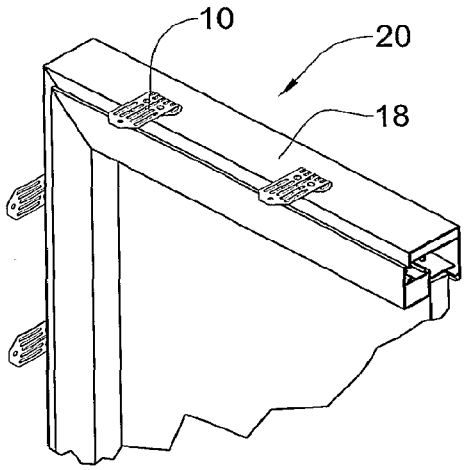
FIG. 7 is a partial view of a the window illustrated in FIG. 2, illustrating still another method of securing the absorber illustrated in FIG. 1 thereto.
Figure 8A:
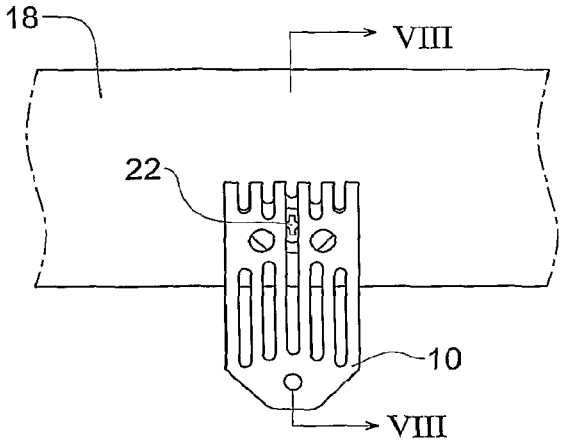
FIG. 8A is a top close-up view of one of the absorbers secured to the window as illustrated in FIG. 7.
Figure 8B:
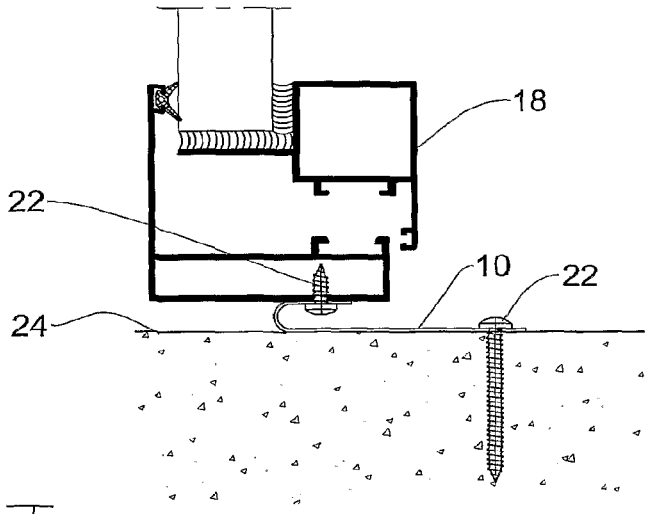
FIG. 8B is a cross-sectional view taken along line VIII-VIII in FIG. 8A.

If desired, the absorber 10 may be bent into a I-shape after being secured to the window, as illustrated in FIGS. 7 through 8B. This may be useful in a situation when installation such as illustrated in FIGS. 5 through 6B is desired, but the available space is limited.

Figure 9:
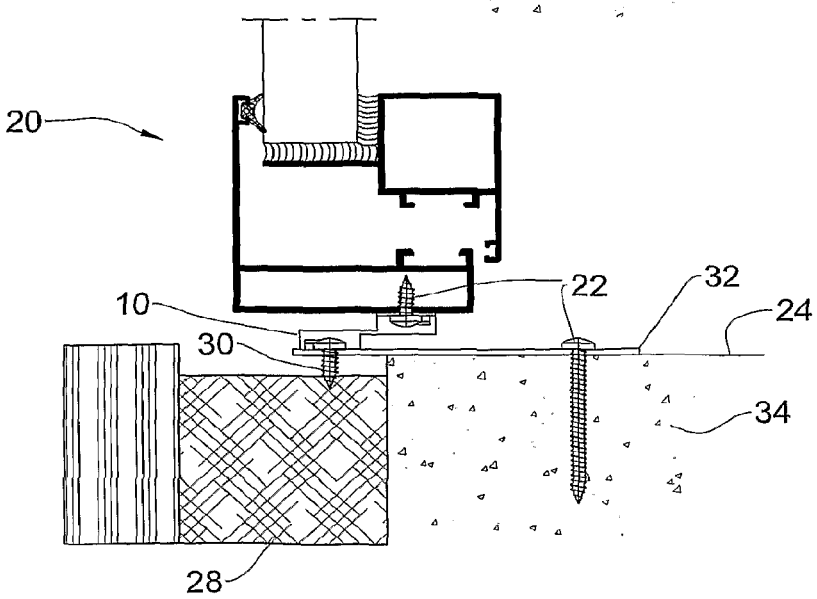
FIG. 9 illustrated a method of securing the absorber illustrated in FIG. 1 to a wall when the wall, in the immediate vicinity of the window, is made of a soft material.

In order for the absorber to be effective, it must be secured to a solid portion of wall. However, there arise situations when it is desired to place the window above a relatively soft portion of construction, such as wood. In such a case, the absorber 10 may be installed as illustrated in FIG. 9. The absorber 10 is secured to the window 20 with a fastener 22 in accordance with the present invention. A solid plate 32 is secured to the surface 24 of the solid portion 34 of the wall, such that a free end overhangs the soft portion 28 thereof. The absorber 10 is secured to the free end of the plate by an auxiliary fastener 30. The absorber works in the same way as described above. It should be noted that the solid plate 32 is not expected to deform substantially in the event of an explosion.

Figure 10:
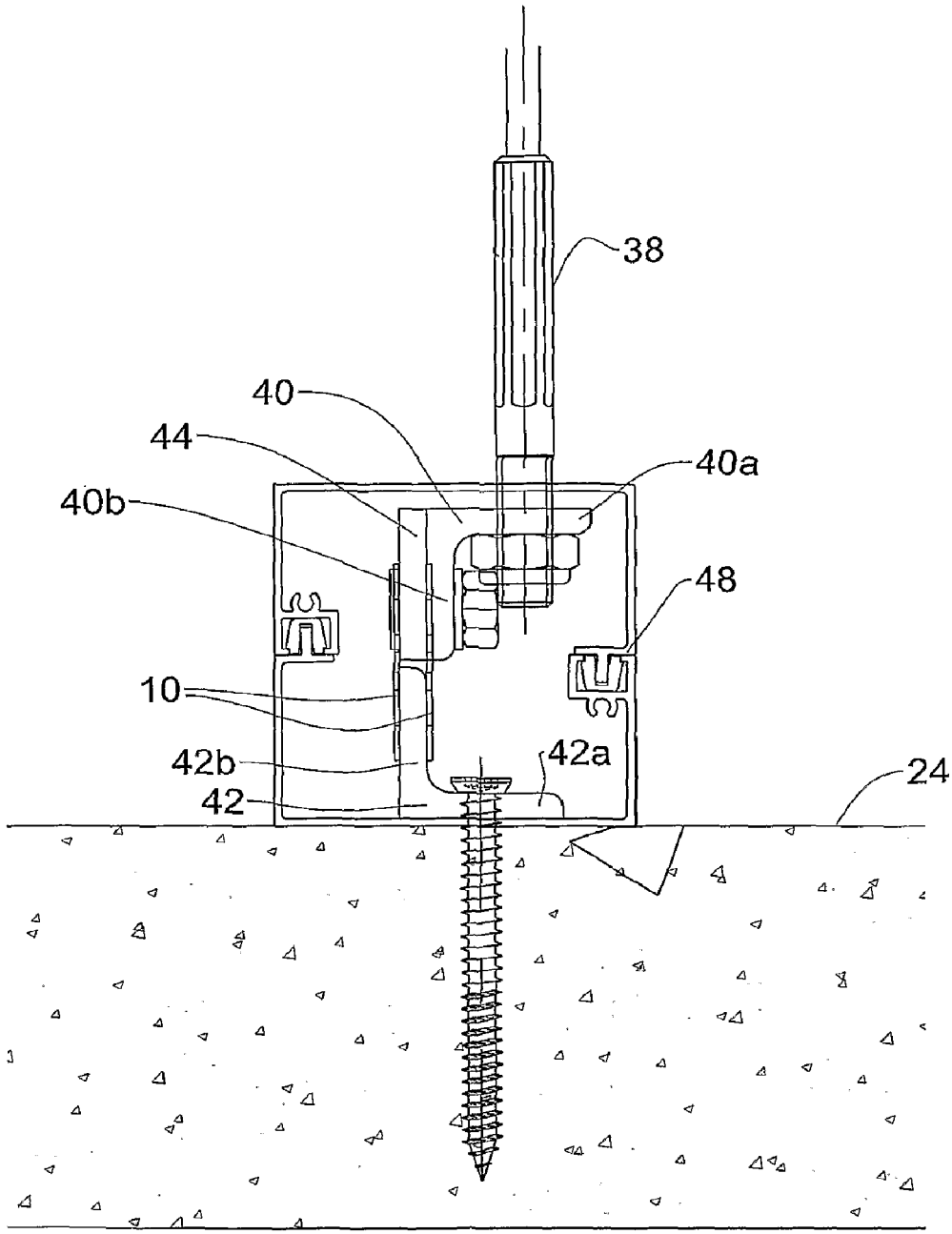
FIG. 10 illustrates a method of securing one or more absorbers illustrated in FIG. 1 to a wall in a cable catch system.

The absorber 10 may further be used in a cable catch system, wherein taut cables are installed between opposite walls, or between a floor and a ceiling, behind a window. Thus, in the event of an explosion, the cable or cables prevent the window from being propelled inwardly. The area of attachment of such an arrangement to the wall (or ceiling/floor), and incorporating the absorber 10 according to the present invention, is illustrated in FIG. 10. As seen, the cable 38 is secured to a first leg 40*a* of a first L-bracket 40, and a first leg 42*a* of a second L-bracket 42 is attached to the surface 24 of the wall which faces the cable. Two absorbers 10 are attached to the second legs 40*b*, 42*b* of the L-brackets 40, 42. Optionally, a plate 44 may be provided between the two absorbers 10, instead of the second leg of one of the L-brackets, with the L-bracket being fastened to the side of one of the absorbers, as shown in FIG. 10. A covering 48 may be provided to conceal the absorber arrangement.

Those skilled in the art to which this invention pertains will readily appreciate that numerous changes, variations and modifications can be made without departing from the scope of the invention *mutatis mutandis.*

The invention claimed is:

1. An energy absorber for use in an opening of a wall of a building, the opening defined by a perimeter surface, the wall supporting a closure substantially filling the opening, the closure having respective edges which are substantially parallel to said perimeter surface of the opening, the energy absorber comprising: a plate comprising a first planar wall connecting portion having a first mounting aperture for mounting the wall connecting portion to the wall, and a second planar closure connecting portion having a second mounting aperture for mounting the closure connecting portion to the closure, the connecting portions being connected by at least one plastically deformable deforming surface, the mounting apertures being provided at a distance from each other along an axis, the deforming surface comprising at least one linear slot having spaced apart slot portions oriented transversely with respect to the axis, the slot having a length exceeding the distance, whereby the deforming surface is configured to absorb, by plastic deformation, a force applied to the closure.

2. An energy absorber according to claim 1, wherein the closure is one selected from the group consisting of a window and a door.

3. An energy absorber according to claim 1, wherein the plate is a metal plate.

4. An energy absorber according to claim 3, wherein said connecting portions are substantially parallel to one another.

5. An energy absorber according to claim 1, wherein the absorber is mounted such that the slots extend parallel to the perimeter surface and to the respective edge.

6. An energy absorber according to claim 1, wherein the absorber is mounted such that the slots extend perpendicular to the perimeter surface and to the respective edge.

7. An energy absorber according to claim 1, wherein the apertures are through-going apertures with one aperture in the wall connecting portion and the other aperture in the closure connecting portion, the apertures being disposed symmetrically about an axis of symmetry of the absorber.

8. An energy absorber according to claim 7, further comprising two additional through-going apertures, disposed symmetrically about a different axis of symmetry of the absorber.

9. A building comprising: at least one opening defining a perimeter surface and fitted with a closure substantially filling the opening, the closure secured to the opening by at least one energy absorber being configured as a plate, the closure having respective edges which are substantially parallel to the perimeter surface of the opening; the energy absorber comprising a planar wall connecting portion having a first mounting aperture for mounting the wall connecting portion to the wall, and a planar closure connecting portion having a second mounting aperture for mounting the closure connecting portion to the closure, the connecting portions being connected by at least one plastically deformable deforming surface therebetween, the mounting apertures being formed at a distance from each other along an axis, the deforming surface further comprising at least one slot having spaced apart slot portions oriented transversely with respect to the axis, the slot having a length exceeding the distance, whereby the deforming surface is configured to absorb, by plastic deformation, a force applied to the closure.

10. A method of securing a closure to an opening in a building wall, comprising the steps of:

providing an energy absorber according to claim 1; and securing the absorber to the opening and the closure such that it lies substantially parallel to facing surfaces of the wall and closure, wherein a force applied of the closure will be absorbed by plastic deformation of the absorber.

11. A method according to claim 10, wherein the closure is one selected from the group consisting of a window and a door.

12. A method according to claim 10, wherein the absorber is secured to the closure such that a longitudinal axis thereof lies substantially parallel to the plane of the closure.

13. A method according to claim 10, wherein the absorber is secured to the closure such that a longitudinal axis thereof lies substantially perpendicular to the plane of the closure.

* * * * *